US008718510B2

(12) United States Patent
Koiwai et al.

(10) Patent No.: US 8,718,510 B2
(45) Date of Patent: May 6, 2014

(54) RECORDING MATERIAL PROCESSING APPARATUS

(75) Inventors: Hideo Koiwai, Kanagawa (JP); Shinya Hara, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 192 days.

(21) Appl. No.: 13/443,456

(22) Filed: Apr. 10, 2012

(65) Prior Publication Data

US 2013/0162132 A1 Jun. 27, 2013

(30) Foreign Application Priority Data

Dec. 26, 2011 (JP) ..... 2011-283432

(51) Int. Cl.
*G03G 15/00* (2006.01)

(52) U.S. Cl.
USPC ..... 399/107; 399/110

(58) Field of Classification Search
CPC ..... G03G 21/1633; G03G 21/1647
USPC ..... 399/107, 110; 312/319.2
See application file for complete search history.

(56) References Cited

U.S. PATENT DOCUMENTS 2,217,570 A * 10/1940 Stroup ..... 312/319.2
5,172,969 A * 12/1992 Reuter et al. ..... 312/319.2
6,079,816 A * 6/2000 Nakamura et al.
2003/0117047 A1* 6/2003 Heidmann et al. ..... 312/319.2
2007/0122187 A1* 5/2007 Mase
2009/0175648 A1* 7/2009 Tsuchiya ..... 399/107
2009/0317126 A1* 12/2009 Tomatsu ..... 399/110
2012/0201569 A1* 8/2012 Hoashi

FOREIGN PATENT DOCUMENTS

JP A-11-084982 3/1999

* cited by examiner

*Primary Examiner* — Susan Lee
(74) *Attorney, Agent, or Firm* — Oliff PLC

(57) ABSTRACT

A recording material processing apparatus includes an apparatus main body including a processing unit, a cover member provided so as to be opened and closed, opened to a predetermined place, and covers a predetermined place on the apparatus main body, a drag applying portion provided in the apparatus main body side and used to apply drag to the cover member opened and closed by a user, and a drag receiving member provided in cover member side, receives the drag from the drag applying portion when drag applying portion presses and the cover member is opened and closed, and is elastically deformed when a portion opposite to the drag applying portion in a state where the cover member is closed and/or a portion opposite to the drag applying portion when the cover member is opened up to the predetermined place is pressed by the drag applying portion.

17 Claims, 12 Drawing Sheets

RECORDING MATERIAL PROCESSING APPARATUS

CROSS-REFERENCE TO RELATED APPLICATIONS

This application is based on and claims priority under 35 USC 119 from Japanese Patent Application No. 2011-283432 filed Dec. 26, 2011.

BACKGROUND

Technical Field

The present invention relates to a recording material processing apparatus.

SUMMARY

According to an aspect of the invention, there is provided a recording material processing apparatus including an apparatus main body that includes a processing unit performing a predetermined processing with respect to a recording material, a cover member that is provided so as to be opened and closed with respect to the apparatus main body, is provided so as to be opened up to a predetermined place, and covers a predetermined place on the apparatus main body, a drag applying portion that is provided in the apparatus main body side and is used so as to apply drag to the cover member opened and closed by a user, and a drag receiving member that is provided in the cover member side, receives the drag from the drag applying portion when the drag applying portion presses and the cover member is opened and closed, and is elastically deformed when a portion placed opposite to the drag applying portion in a state where the cover member is closed and/or a portion placed opposite to the drag applying portion when the cover member is opened up to the predetermined place is pressed by the drag applying portion.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the present invention will be described in detail with reference to the accompanying drawings.

Figure 1:
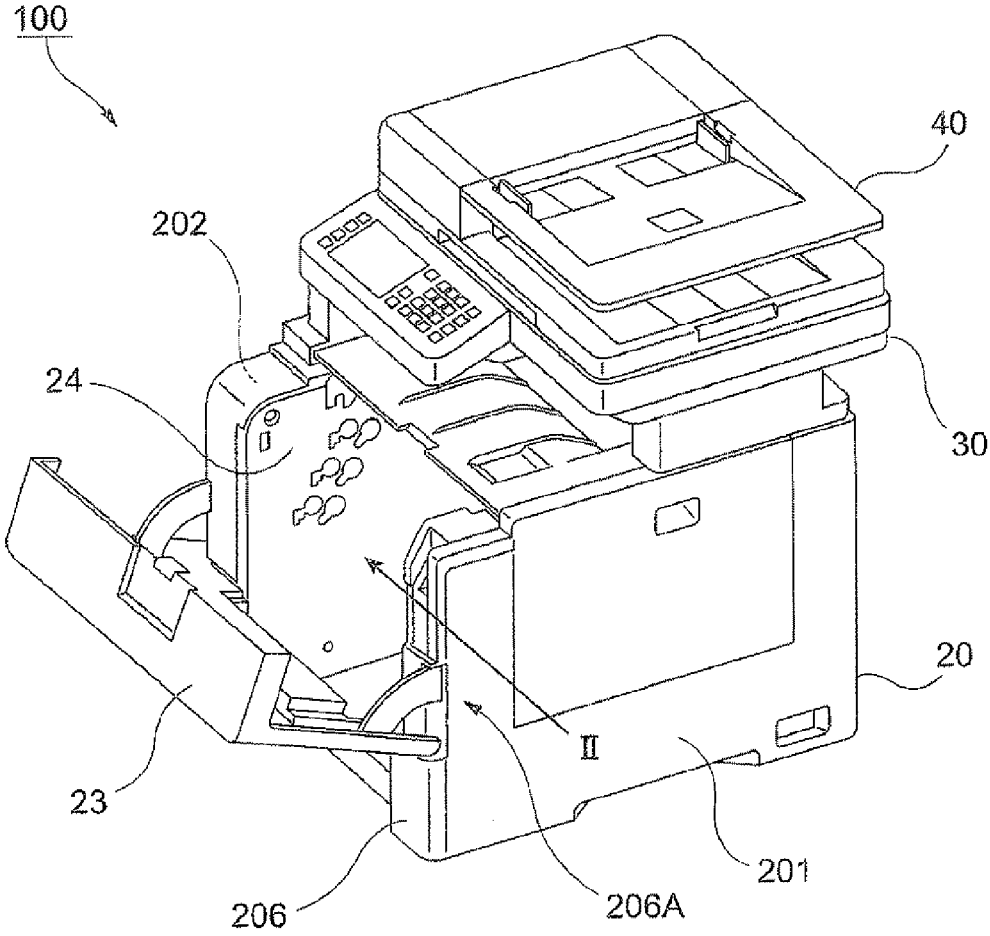
FIG. 1 is a view showing an image forming apparatus according to the present exemplary embodiment.

FIG. 1 is a view showing an image forming apparatus 100 according to the present exemplary embodiment. An apparatus main body 20 is provided in the image forming apparatus 100 which is an example of a recording material processing apparatus, and the main body includes an image forming section (not shown), which performs image forming on paper which is an example of recording material, in the inner portion. Moreover, in the image forming apparatus 100 of the present exemplary embodiment, a scanner device 30 is provided on the upper portion of the apparatus main body 20, and a document feeding device 40 which feeds documents with respect to the scanner device 30 is provided on the upper portion of the scanner device 30.

Here, in the apparatus main body 20, a first side wall 201 is provided on the right side when viewed from the front side of the image forming apparatus 100. A second side wall 202 is provided on the left side when viewed from the front side of the image forming apparatus 100. In the present exemplary embodiment, an opening, which allows access to the inner portion of the apparatus main body 20, is formed on the front side of the image forming apparatus 100 in the apparatus main body 20. In the present exemplary embodiment, a cover member 23 which covers and closes the opening is provided. In the present exemplary embodiment, a fourth side wall (not shown) is provided in the rear side of the image forming apparatus 100 in the apparatus main body 20.

The cover member 23 is provided so as to move (cover member is provided so as to be opened and closed with respect to the apparatus main body 20), and the opening which is formed on the apparatus main body 20 is exposed by pulling the cover member 23 to the front side of the image forming apparatus 100. In the present exemplary embodiment, as shown in FIG. 1, a supporting plate 24, which supports members provided in the inner portion of the apparatus main body 20, is provided in the inner portion of the apparatus main body 20. Here, the supporting plate 24 is disposed in a state of being opposite to the second side wall 202.

For example, the image forming section (not shown) which is an example of a processing unit provided in the inner portion of the apparatus main body 20 may include a photoconductor drum, a charger which charges the photoconductor drum, a laser exposure unit which radiates laser light on the photoconductor drum and forms an electrostatic latent image, a developing device which develops the electrostatic latent image formed on the photoconductor drum by using toner, and a transfer unit which transfers the toner image formed on the photoconductor drum on the paper. In the present exemplary embodiment, a case where an image is formed by an electrophotographic system is exemplified. However, the image may be formed by an inkjet printing system or the like.

Figure 2:
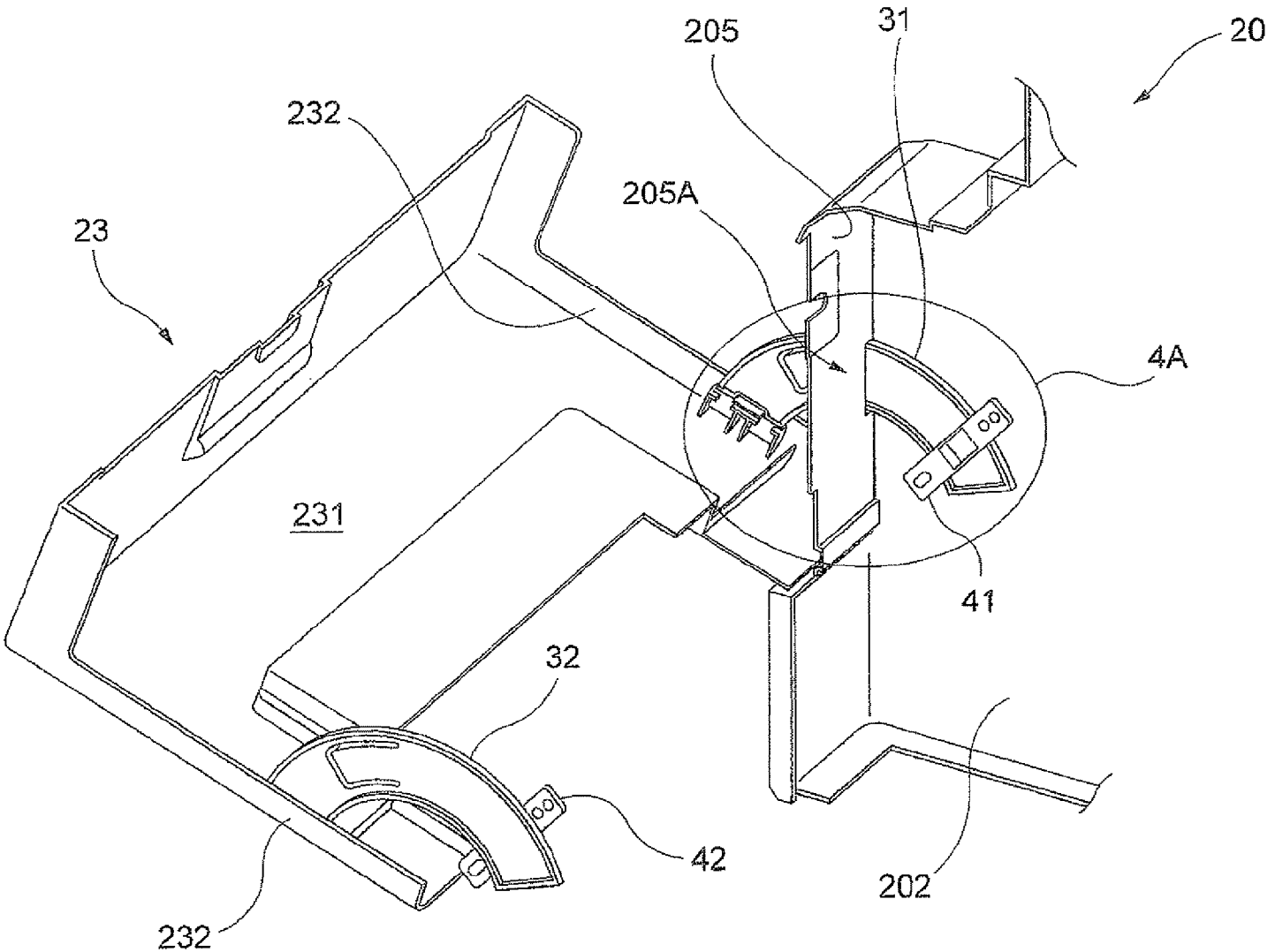
FIG. 2 is a view when an apparatus main body is viewed from a direction of an arrow II in FIG. 1.

FIG. 2 is a view when an apparatus main body 20 is viewed from a direction of an arrow II in FIG. 1. FIG. 2 shows a state where the supporting plate 24 shown in FIG. 1 is removed.

Although the description is omitted in the above, in the present exemplary embodiment, a first regulating member 31 and a second regulating member 32 which regulate movement of the cover member 23 are provided. Here, the first regulating member 31 and the second regulating member 32 are each mounted on the cover member 23 and are provided toward the apparatus main body 20 from the cover member 23. The first regulating member 31 and the second regulating member 32 each include one end which is mounted on the cover member 23 and the other end of the apparatus main body 20 side. The first regulating member 31 and the second regulating member 32 are each formed in a flat plate shape.

Here, as described above, the cover member 23 is provided so as to move toward the front side of the image forming apparatus 100. However, if there is not any restriction present, the cover member 23 is opened more than necessary. Thereby, in the present exemplary embodiment, the movement of the cover member 23 is regulated by providing the first regulating member 31 and the second regulating member 32, and the cover member 23 which is opened by a user is stopped at a predetermined place.

As shown in FIG. 2, the first regulating member 31 is mounted on one end in a width direction of the cover member 23, and as shown in FIG. 2, the second regulating member 32 is mounted on the other end in the width direction of the cover member 23. Additionally, the first regulating member 31 is provided on the second side wall 202 side, and the second regulating member 32 is provided on the first side wall 201 (refer to FIG. 1) side. In the present exemplary embodiment, a first contact member 41 which contacts one side surface of the first regulating member 31 and regulates the movement of the first regulating member 31, and a second contact member 42 which contacts one side surface of the second regulating member 32 and regulates the movement of the second regulating member 32 are provided. The first contact member 41 is mounted on the surface of the inner side of the second side wall 202, and the second contact member 42 is mounted on the surface of the inner side of the first side wall 201.

Although description is omitted in the above, as shown in FIG. 2, a fifth side wall 205 in which a through hole 205A is formed is provided in the side in which the second side wall 202 is provided in the front side of the apparatus main body 20. In the present exemplary embodiment, the first regulating member 31 which is mounted on the cover member 23 passes through the through hole 205A which is formed in the fifth side wall 205. As shown in FIG. 1, a sixth side wall 206 is provided in the side in which the first side wall 201 is provided in the front side of the apparatus main body 20, and the second regulating member 32 which is mounted on the cover member 23 passes through a through hole 206A which is formed in the sixth side wall 206.

Figure 3A:
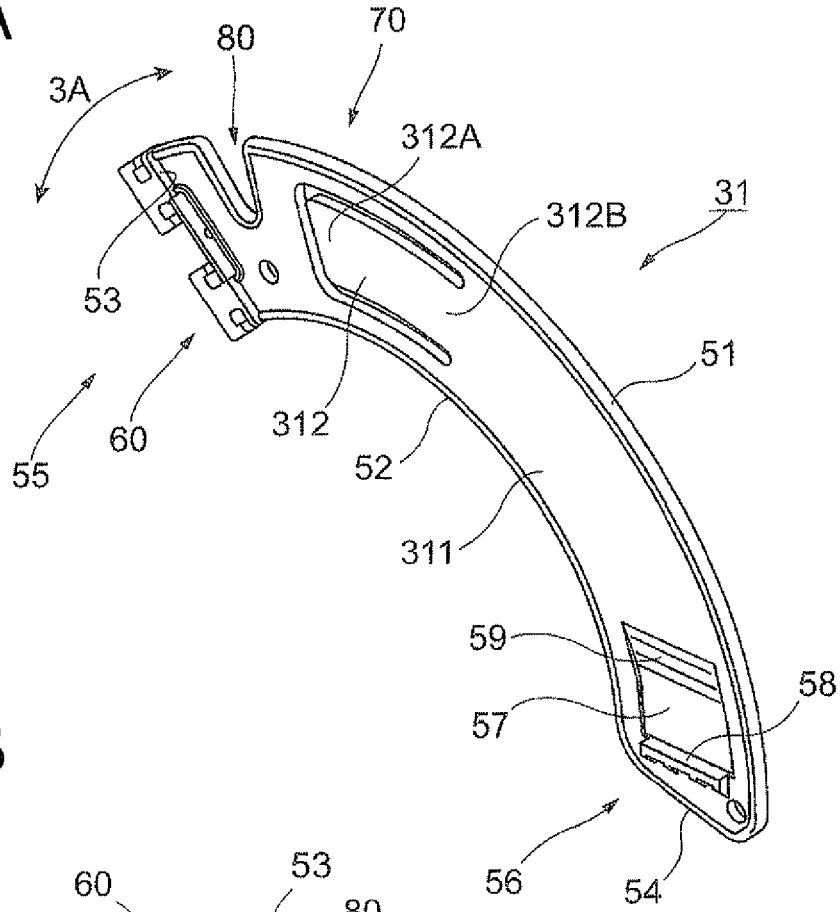
FIGS. 3A and 3B are views for illustrating a first regulating member.
Figure 3B:
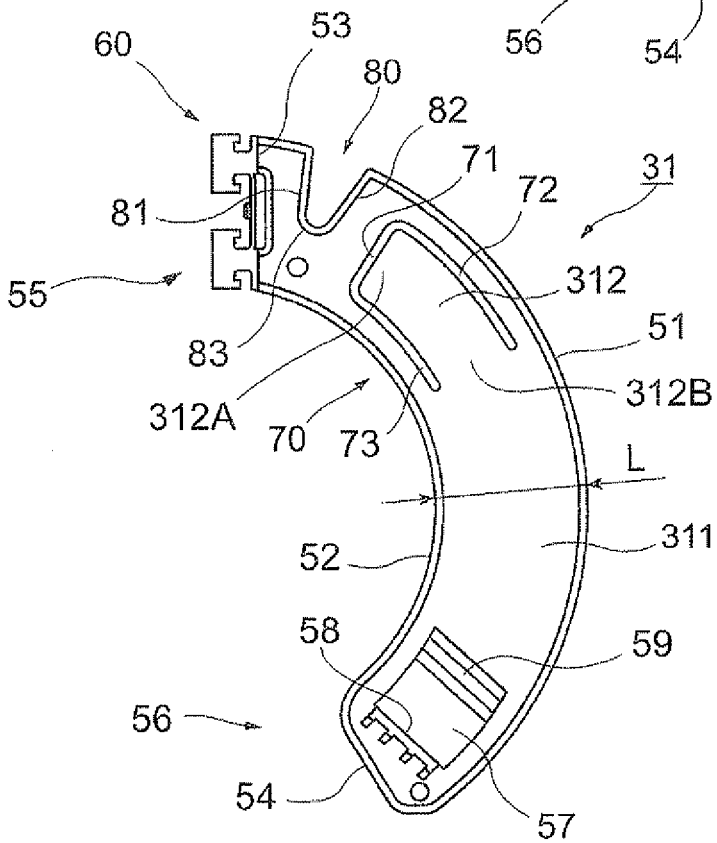

FIGS. 3A and 3B are views for illustrating the first regulating member 31. FIG. 3A is a perspective view of the first regulating member 31, and FIG. 3B is a view when the first regulating member 31 is viewed from the front.

As shown in FIG. 3B, the first regulating member 31 is formed so as to describe an arc while having a width L. To explain further, as shown in FIGS. 3A and 3B, the first regulating member 31 includes a main body portion 311 which is formed in a flat plate shape, is formed so as to have a predetermined thickness, and is formed in a C shape, and an elastic piece 312 (details will be described below) which functions as a bending piece, or the like.

Here, as shown in FIG. 3B, the main body 311 includes a first lateral side 51 which is formed so as to describe an arc and have a first curvature, and a second lateral side 52 which is formed so as to be parallel to the first lateral side 51 and have a second curvature which is greater than the first curvature. In addition, a third lateral side 53, which is disposed in one end 55 in the longitudinal direction of the first regulating member 31 and connects the first lateral side 51 and the second lateral side 52 to each other, is provided in the main body portion 311. A fourth lateral side 54, which is disposed in the other end 56 in the longitudinal direction of the first regulating member 31 and connects the first lateral side 51 and the second lateral side 52 to each other, is provided in the main body portion 311.

In the present exemplary embodiment, as shown in FIGS. 3A and 35, a recessed portion 57 having a shape which is rectangular when viewed from the front is formed in the other end 56 of the first regulating member 31. In addition, a projecting portion 58 is formed toward the fourth lateral side 54 side from the recessed portion 57, and the projecting portion 58 is formed from the side in which the second lateral side 52 is provided toward the side in which the first lateral side 51 is provided and protrudes from the surface of the main body portion 311. An inclined surface 59 is formed in the third lateral side 53 side in the recessed portion 57, the inclined surface is formed so as to connect the bottom surface of the recessed portion 57 and the surface of the main body portion 311, and the height of the inclined surface gradually increases from the side in which the fourth lateral side 54 is provided toward the side in which the third lateral side 53 is provided. In the present exemplary embodiment, as shown in FIGS. 3A and 3B, amounting portion 60 which is mounted with respect to the cover member 23 (refer to FIG. 2) is provided in the third lateral side 53.

As shown in FIGS. 3A and 35, a slit 70, which is provided so as to penetrate the main body portion 311 and is formed in a U shape, is provided in the one end 55 side (third lateral side 53 side) in the main body portion 311. In the present exemplary embodiment, an elastic piece 312 which may be displaced in the thickness direction of the main body portion 311 is provided in the main body 311 by the slit 70. Additionally, in the present exemplary embodiment, due to the fact that the slit 70 is provided, the bending elastic piece 312, which has one end 312A positioned in the one end 55 side of the first regulating member 31 as a free end and the other end 312B positioned in the other end 56 side of the first regulating member 31 as a fixed end, is provided.

As shown in FIG. 3B, the slit 70 includes a first slit 71 which has one end and the other end and is provided from the side in which the second lateral side 52 is provided toward the side in which the first lateral side 51 is provided, a second slit 72 which is connected to the one end of the first slit 71 and extends from the one end toward the fourth lateral side 54, and a third slit 73 which is connected to the other end of the first slit 71 and extends from the other end toward the fourth lateral side 54.

In the present exemplary embodiment, as shown in FIGS. 3A and 3B, a notch 80 is provided toward the second lateral side 52 in a portion positioned between the third lateral side 53 and the slit 70 in the first lateral side 51. Here, the notch 80 is formed in a triangle.

In the present exemplary embodiment, as shown in FIG. 3B, a first side 81, which is provided from the first lateral side 51 toward the second lateral side 52, is provided in a place which is opposite to the notch 80 in the main body portion 311. Similarly, a second side 82, which is provided from the first lateral side 51 toward the second lateral side 52 and is formed so that an angle between the first side 81 and the second side 82 is an acute angle, is provided, and a third side 83 which connects the end of the first side 81 and the end of the second side 82 is provided. Here, the third side 83 is not linearly formed and is formed so as to extend in an arc shape toward the second lateral side 52 side. In the present exemplary embodiment, the notch 80 is formed so that the angle between the first side 81 and the second side 82 is an acute angle. However, the notch 80 may be formed so that the first side 81 is parallel to the second side 82.

Although the description is omitted in the above, the recessed portion 57, the projecting portion 58, and the inclined surface 59 which are formed in one surface side of the first regulating member 31 are also formed in the rear surface side (other surface side) of the first regulating member 31. Additionally, the recessed portion 57, the projecting portion 58, and the inclined surface 59 are also formed on the surface of the rear side in the drawing of the first regulating member 31 shown in FIGS. 3A and 3B. Thereby, in the present exemplary embodiment, common utilization of the first regulating member 31 and the second regulating member 32 is possible, and the first regulating member 31 may be used as the second regulating member 32 described in FIG. 2.

Next, a structure of the apparatus main body 20 side will be described in detail.

Figure 4:
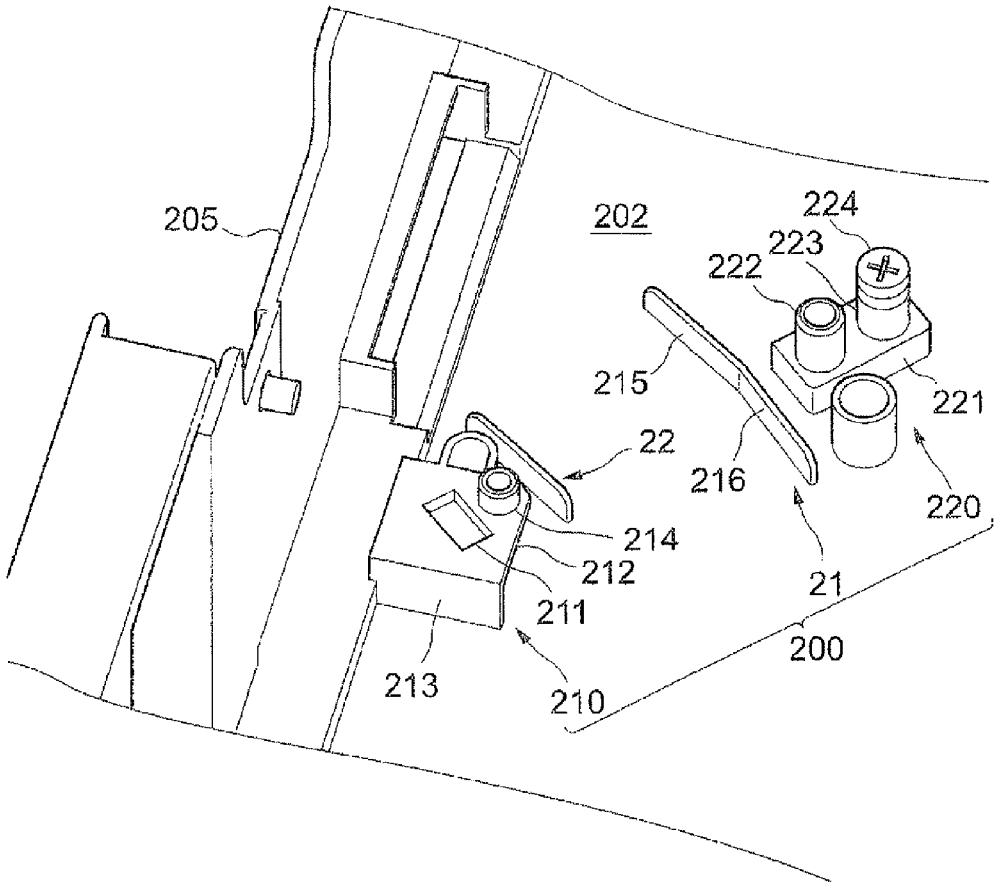
FIG. 4 is a view enlarging a portion shown by a reference numeral 4A in the apparatus main body shown in FIG. 2.

FIG. 4 is a view enlarging a portion shown by a reference numeral 4A in the apparatus main body 20 shown in FIG. 2. In the present exemplary embodiment, the second side wall 202 side and the first side wall 201 side in the apparatus main body 20 are configured so as to similar to each other. Thereby, the description below focuses on the second side wall 202 side, and the description regarding the first side wall 201 side is omitted.

As shown in FIG. 4, in the present exemplary embodiment, a first protrusion 21 and a second protrusion 22, which are formed in a rib shape and protrude from the inner wall of the second side wall 202 in the inner wall, are provided. Here, the first protrusion 21 and the second protrusion 22 have first ends in the fifth side wall 205 side and second ends in the inner portion side of the apparatus main body 20. The first protrusion 21 and the second protrusion 22 are formed in an inclined state toward the lower portion of the apparatus main body 20 from the first ends toward the second ends. In the present exemplary embodiment, the length from the one end to the other end in the first protrusion 21 is longer than the length from the one end to the other end in the second protrusion 22.

The first protrusion 21 includes a first portion 215 which is linearly formed when viewed from the front and a second portion 216 which is disposed in the further inner portion side of the apparatus main body 20 rather than the first portion 215 and is linearly formed similarly when viewed from the front. Here, the first portion 215 and the second portion 216 are inclined toward the lower portion of the apparatus main body 20 from the one end toward the other end. However, the inclined angles are different from each other, and the inclined angle of the second portion 216 is greater than the inclined angle of the first portion 215.

In the present exemplary embodiment, a fixing portion 200 which fixes the first contact member 41 (refer to FIG. 2) is provided in the inner wall of the second side wall 202. Here, the fixing portion 200 includes a first fixing portion 210 which fixes one end in the longitudinal direction of the first contact member 41 and a second fixing portion 220 which fixes the other end in the longitudinal direction of the first contact member 41.

Here, in the first fixing portion 210, an opposing portion 212 in which a through hole 211 having a rectangular shape is formed and which is disposed while having a gap between the opposing portion and the second side wall 202 and is disposed so as to opposite to the second side wall 202, and a support portion 213 which is disposed between the opposing portion 212 and the second side wall 202 and supports the opposing portion 212 are provided. Moreover, a protrusion 214 which is formed in a cylindrical shape and protrudes from the surface of the opposing portion 212 is provided in the first fixing portion 210.

A projecting portion 221 which is formed in a rectangular parallelepiped shape and protrudes from the surface of the second side wall 202 is provided in the second fixing portion 220. A first protrusion 222 which is formed in a cylindrical shape and protrudes from the surface of the projecting portion 221, a second protrusion 223 which is formed in a cylindrical shape and in which a screw hole is formed in the inner portion, and a screw 224 which is fixed to the second protrusion 223 are provided. Although the description is omitted, the rib-shaped first protrusion 21 and the second protrusion 22 which are described above are provided between the first fixing portion 210 and the second fixing portion 220.

Here, in the present exemplary embodiment, the one end of the first contact member 41 (refer to FIG. 2) is fixed by the first fixing portion 201 and the other end of the first contact member 41 is fixed by the second fixing portion 220. Here, when the fixing is performed, first, the first regulating member 31 is set so that the first regulating member 31 is disposed on the rib-shaped first protrusion 21 and the second protrusion 22. Thereafter, the first contact member 41 is fixed with respect to the second side wall 202 by using the first fixing portion 210 and the second fixing portion 220. Thereby, the first regulating member 31 is disposed between the first contact member 41 and the second side wall 202.

Figure 5:
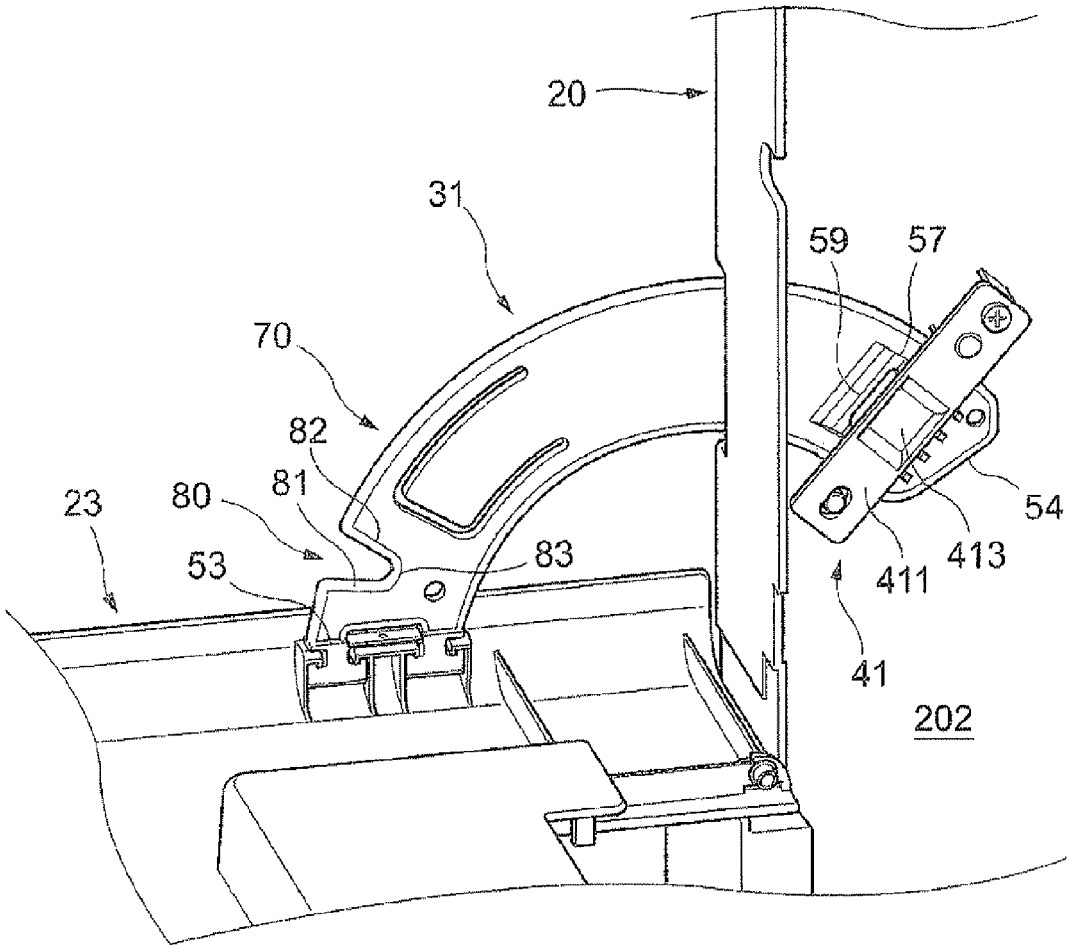
FIG. 5 is a view showing the state of the first regulating member or the like in a state where a cover member is opened.

FIG. 5 is a view showing the state of the first regulating member 31 or the like in a state where a cover member 23 is opened.

Here, first, if the first contact member 41 is further described, the first contact member 41 of the present exemplary embodiment includes a main body portion 411 which is formed in a plate shape and a rectangular shape and a projecting portion 413 which is provided in a center portion in the longitudinal direction of the main body portion 411 and protrudes toward the second side wall 202.

Here, when the cover member 23 is opened by a user, the first regulating member 31 is drawn from the inner portion of the apparatus main body 20 according to the movement of the cover member 23. If the first regulating member 31 is drawn by a predetermined amount, the projecting portion 58 (refer to FIGS. 3A and 3B) which is provided in the first regulating member 31 collides with the projecting portion 413 which is provided in the first contact member 41. If the collision is generated, the movement of the first regulating member 31 is regulated, and the movement of the cover member 23 which is operated so as to be opened by a user is stopped.

Here, if the operation of the cover member 23 opened by a user is completed, as shown in FIG. 5, the projecting portion 413 of the first contact member 41 is inserted into the recessed portion 57 (refer to FIG. 3A) which is formed in the first regulating member 31. Thereby, a load which acts on the first regulating member 31 from the first contact member 41 (load which acts in the thickness direction of the first regulating member 31) is decreased. Additionally, the load which is applied to the first regulating member 31 is decreased and it is difficult for deformation of the first regulation member 31 to be generated.

Although the description is omitted in the above, during the opening operation or the closing operation of the cover member 23 by a user, the first contact member 41 and the first regulating member 31 rub against each other, and a frictional force operates on the first regulating member 31. Additionally, in the present exemplary embodiment, during the opening operation or the closing operation of the cover member 23 by a user, drag is applied from the first contact member 41 which functions as a drag applying portion to the first regulating member 31 which functions as a drag receiving member. Thereby, in the present exemplary embodiment, during the opening operation or the closing operation of the cover member 23, even though the hand of the user is separated from cover member 23, the cover member 23 stays at the place or slowly opens (is lowered).

In the present exemplary embodiment, the first regulating member 31 is formed in a flat plate shape. As a result, even though a load which twists the first regulating member 31 acts on the first regulating member 31, it is difficult for deformation of the first regulating member 31 to be generated. More specifically, even though the load which twists the first regulating member 31 acts on the first regulating member 31 in a direction indicated by an arrow 3A in FIG. 3A, it is difficult for deformation of the first regulating member 31 to be generated. As a result, in the present exemplary embodiment, operability is improved when the cover member 23 is opened and closed. Additionally, if it is difficult for deformation of the first regulating member 31 to be generated, behavior of the cover member 23 when the cover member 23 is opened and closed becomes stable, and operability when the cover member 23 is opened and closed is improved.

Here, like the present exemplary embodiment, in the case where the projecting portion 413 of the first contact member 41 is inserted into the recessed portion 57 which is formed in the first regulating member 31, the operation load which is required when the closing operation of the cover member 23 starts is decreased. Thereby, the cover member 23 is easily closed and operability of the cover member 23 is improved. In the present exemplary embodiment, the inclined surface 59 is formed with respect to the first regulating member 31. Thereby, compared to the case where the inclined surface 59 is not formed, it is difficult for catching of the projection portion 413 with respect to an edge of the recessed portion 57 to occur. Even in this case, the cover member 23 is easily closed and operability of the cover member 23 is improved.

In the present exemplary embodiment, the first regulating member 31 is fixed with respect to the cover member 23 without using fastening members such as a screw (details will be described below), and therefore, reduction in the number of parts is facilitated. However, when the first regulating member 31 is fixed without using fastening members such as a screw, the first regulating member 31 is easily removed from the cover member 23. Thereby, in the present exemplary embodiment, recessed portions or protrusions are provided in the first regulating member 31 and the cover member 23, the protrusions are fitted into the recessed portions, and it is difficult for removal of the first regulating member 31 to occur (details will be described below). However, if the recessed portions or the protrusions are formed, portions in which stress easily occurs are generated, and damage or the like is easily generated in the parts. Thereby, in the present exemplary embodiment, the notch 80 is formed with respect to the first regulating member 31 and alleviation of the stress is improved.

Here, in the configuration of the present exemplary embodiment, if the cover member 23 is pulled downward in FIG. 5 and similarly, the first regulating member 31 is pulled downward, the first regulating member 31 is elastically deformed so that the first side 81 and the second side 82 which is provided so as to be opposite to the notch 80 are separated from each other. Thereby, the stress which is generated in a connection portion between the first regulating member 31 and the cover member 23 is alleviated. Moreover, in the present exemplary embodiment, as illustrated in FIGS. 3A and 3B, the third side 83 which is formed so as to describe an arc is disposed between the first side 81 and the second side 82. Here, for example, if the linear first side 81 and the similarly linear second side 82 are directly connected to each other, stress is concentrated in the connection portion between the first side 81 and the second side 82. However, when the above-described third side 83 is provided, it is difficult for concentration of stress to be generated.

A position in which the notch 80 is provided is not limited to the position described above. In the present exemplary embodiment, as described above, the case where the notch 80 is provided between the slit 70 and the third lateral side 53 is described. However, the notch 80 may be provided in the fourth lateral side 54 side from the slit 70. In addition, the number of the notches 80 is not particularly limited and maybe provided in plural. In the present exemplary embodiment, the case where the notch 80 is provided in the first lateral side 51 (refer to FIGS. 3A and 3B) is described. However, the notch 80 may be provided in the second lateral side 52. The notch 80 may be formed in both the first lateral side 51 and the second lateral side 52.

Figure 6:
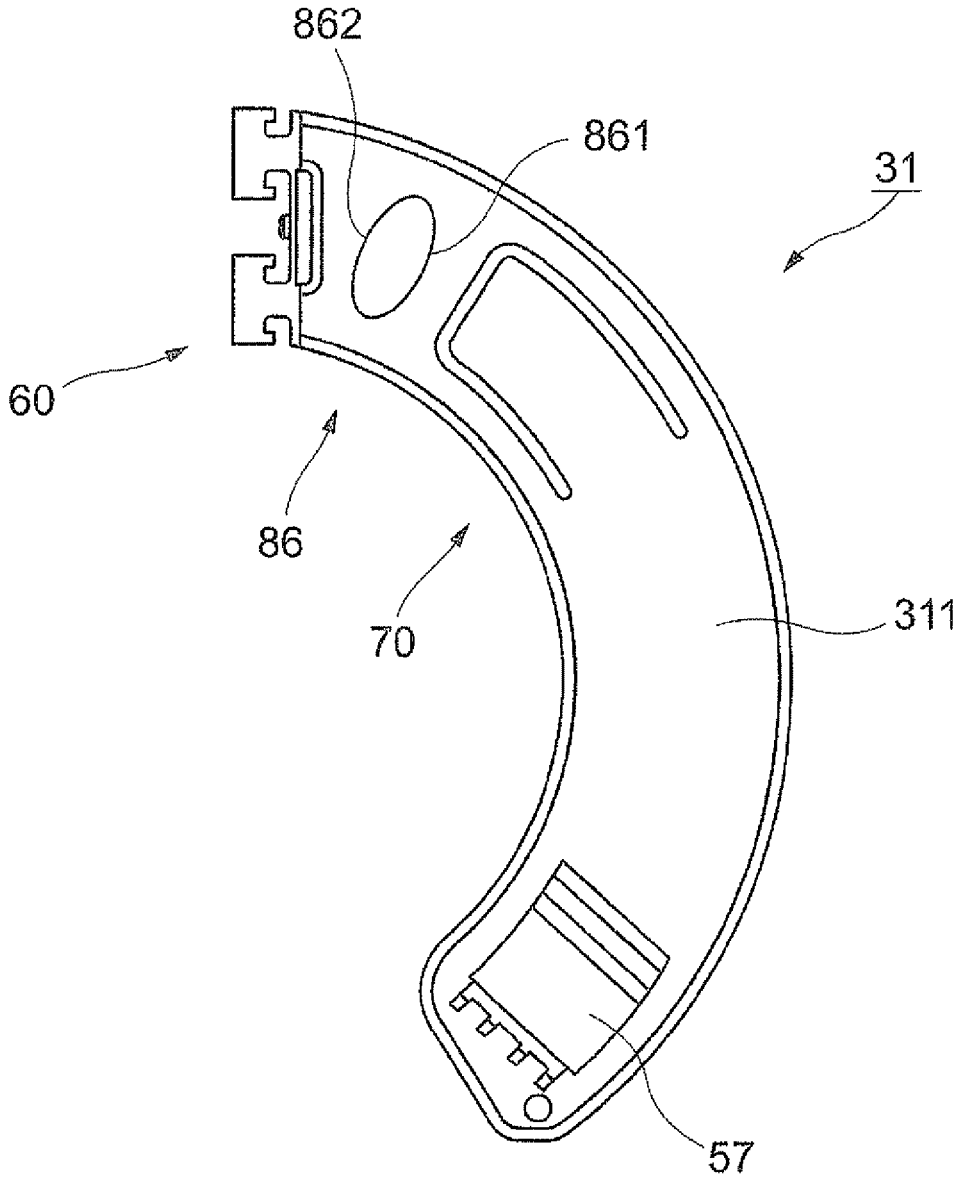
FIG. 6 is a view showing another configurational example of the first regulating member.

In the above, the case where the notch 80 is formed is described. However, for example, as shown in FIG. 6 (view showing another configurational exemplary embodiment of the first regulating member 31), an elliptical through hole 86 may be formed in the first regulating member 31. In this way, when the through hole 86 is formed, the first regulating member 31 is elastically deformed so that a first long side portion 861 and a second long side portion 862 are separated from each other. Thereby, the stress which is generated in the connection portion between the first regulating member 31 and the cover member 23 is alleviated. The through hole 86 is not limited to the elliptical shape, and for example, may be a circular shape, a quadrilateral shape, or a diamond shape. The number of through holes 86 is not limited to single and may be plural. When through holes 86 are provided in plural, each through hole 86 may be disposed in a state of being shifted in the longitudinal direction of the first regulating member 31, and each through hole 86 may be disposed in a state of being shifted in the width direction of the first regulating member 31.

Figure 7:
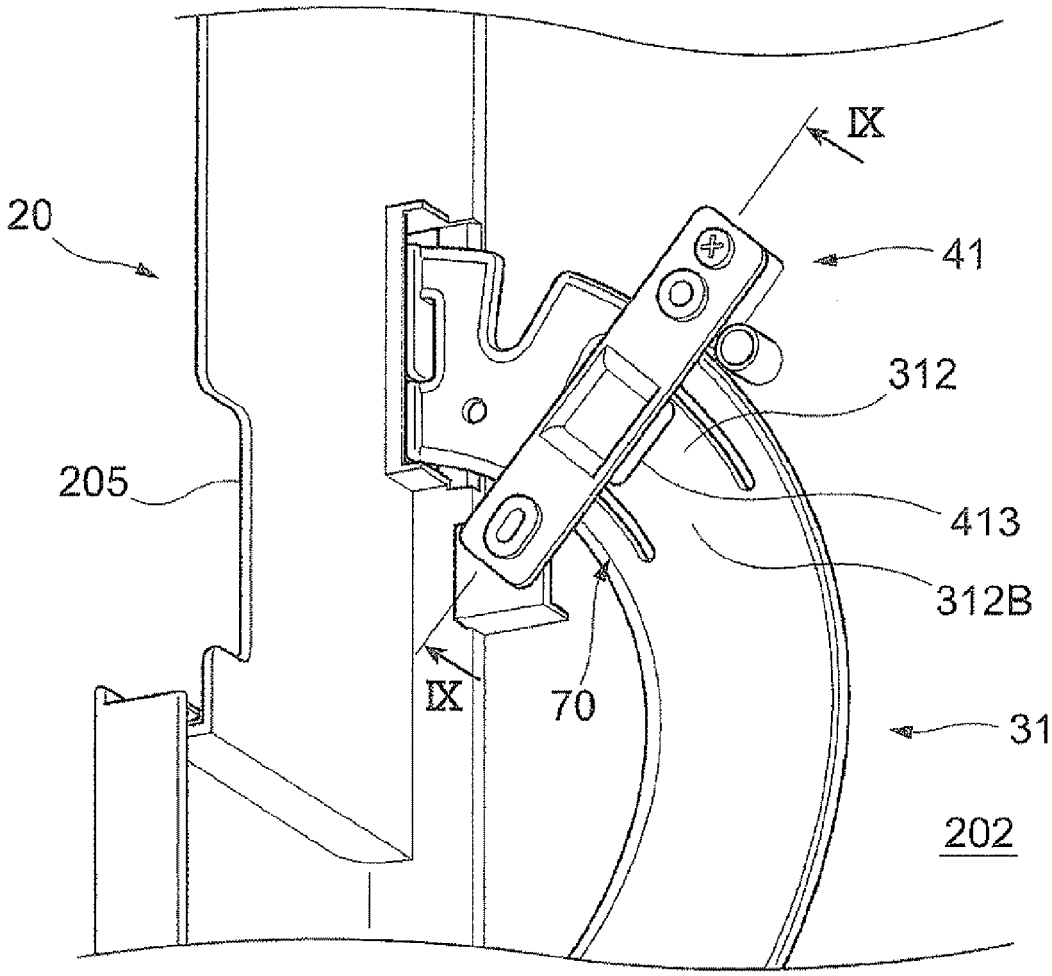
FIG. 7 is a view showing the state of the first regulating member or the like in a state where a cover member is closed.

FIG. 7 is a view showing the state of the first regulating member 31 or the like in a state where the cover member 23 is closed.

When the cover member 23 is closed by a user, the first regulating member 31 is pressed by the cover member 23 and the first regulating member 31 moves in the direction of the inner portion of the apparatus main body 20. If the cover member 23 is completely closed, the state shown in FIG. 7 is reached. In this state, as shown in FIG. 7, the elastic piece 312 of the first regulating member 31 is positioned at the position opposed to the projecting portion 413 which is provided in the first contact member 41, and the elastic piece 312 is pressed by the projecting portion 413. Thereby, the elastic piece 312 is bent toward the second side wall 202 (is elastically deformed) while having the other end 312B of the elastic piece 312 as the fixed end and the one end 312A of the elastic piece 312 as the free end (refer to FIGS. 3A and 3B).

Here, in this way, in the case of the construction in which the elastic piece 312 is bent, similarly to the above, the load which acts on the first regulating member 31 from the first contact member 41 is decreased. In this case, the operation load which is required when the opening operation of the cover member 23 starts is decreased. Also in this case, the cover member 23 is easily opened and operability of the cover member 23 is improved.

In addition, also due to the fact that a through hole or a recessed portion is formed in a portion which is surrounded by the U-shaped slit 70 without providing the elastic piece 312, the projecting portion 413 of the first contact member 41 is inserted into the through hole or the recessed portion, and the load which acts on the first regulating member 31 from the first contact member 41 is decreased. Also in this case, the operation load, which is required when the opening operation of the closed cover member 23 starts, may be decreased.

However, in this case, the projecting portion 413 of the first contact member 41 easily catches on edges of the through hole or the recessed portion when the opening operation of the cover member 23 is performed, and operability of the cover member 23 is easily decreased. Here, for example, due to the fact that the included surface 59 shown in FIGS. 3A and 3B is formed in the edge of the through hole or the edge of the recessed portion, it may be difficult for catching to occur. However, even though the inclined surface 59 is formed, it is difficult to eliminate catching. Additionally, even though the inclined surface 59 is formed, a gap is formed between the inclined surface 59 and the projecting portion 413 due to machine error or the like. In addition, if the opening operation of the cover member 23 is performed in this state, the projecting portion 413 collides with the inclined surface 59. In this case, when the cover member 23 is opened, the cover member 23 catches on the apparatus main body 20 side. Therefore, in this case, operability of the cover member 23 is decreased.

Figure 8:
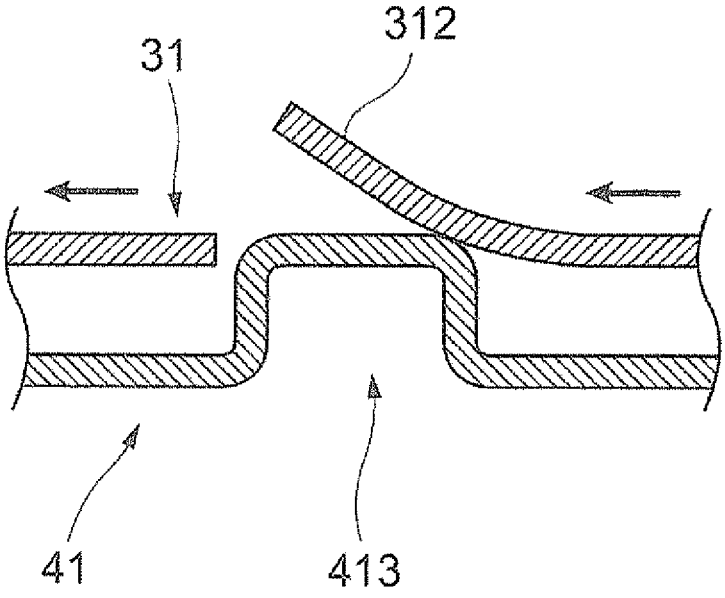
FIG. 8 is a cross-sectional view in a case where an elastic piece is pressured by a projecting portion.

On the other hand, in the case where the above-described elastic piece 312 is provided, as shown in FIG. 8 (a cross-sectional view in a case where the elastic piece 312 is pressured by the projecting portion 413), the projecting portion 413 is pressed to the elastic piece 312. To explain further, an inclined surface is formed by using the bending of the elastic piece 312. In the case of this configuration, when the opening operation of the cover member 23 is performed, the first regulating member 31 moves in the state where the contact between the outer surface of the elastic piece 312 and the projecting portion 413 is maintained. In addition, in this case, collision of the projecting portion 413 with respect to the first regulating member 31 is not generated. In the case, catching does not occur when the opening operation of the cover member 23 is performed, and the opening operation of the cover member 23 is easily performed.

In the present exemplary embodiment, a portion of the first regulating member 31 is elastically deformed by providing the elastic piece 312. However, also according to the other methods, a portion of the first regulating member 31 may be elastically deformed. For example, due to the fact that a recessed portion is formed in a portion of the first regulating member 31 (a place which confronts the projecting portion 413 when the cover member 23 is closed) and a soft rubber material is fitted into the recessed portion, a portion of the first regulating member 31 may be elastically deformed.

Figure 9:
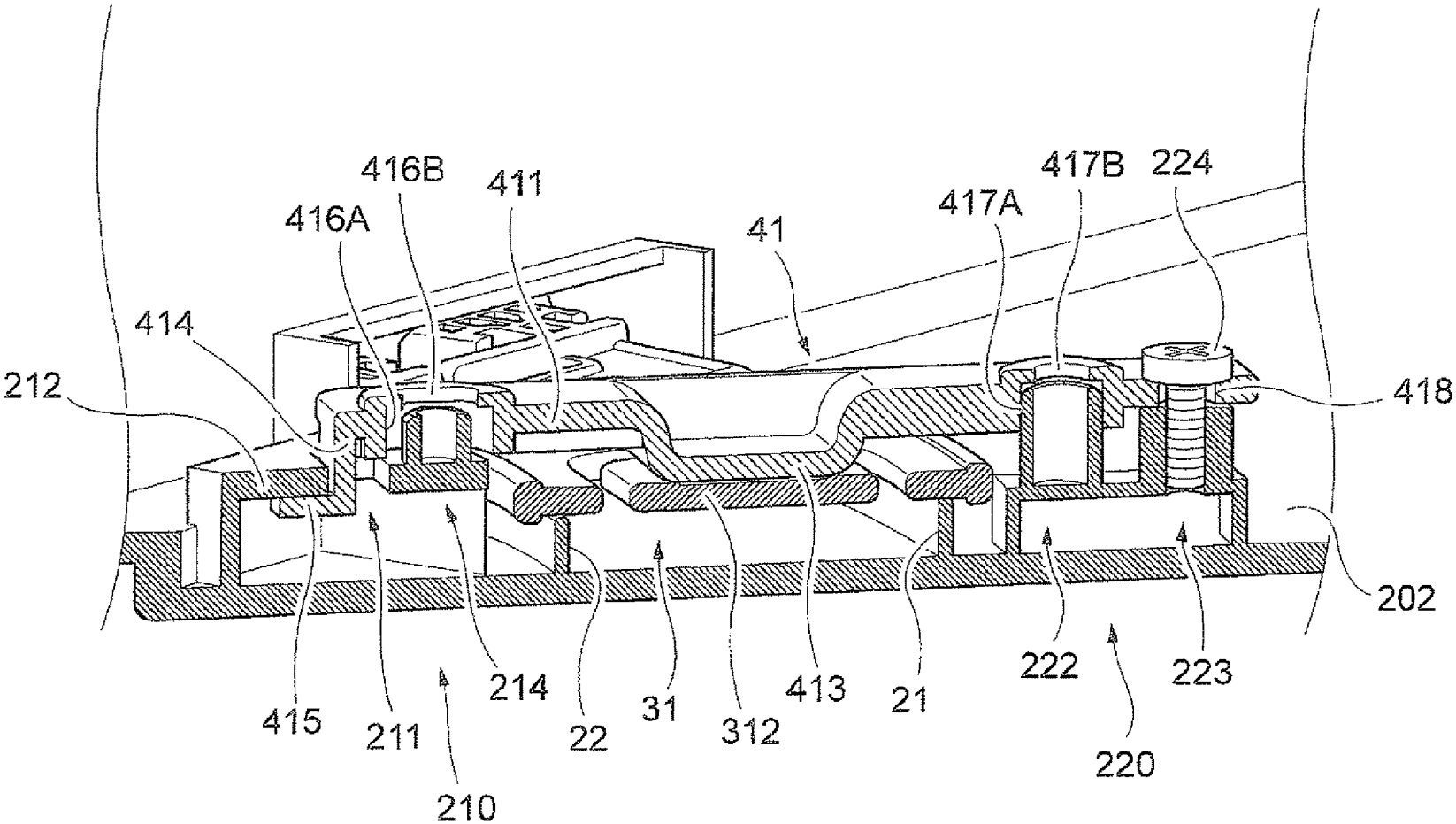
FIG. 9 is a cross-sectional view taken along an arrow IX-IX of FIG. 7.

FIG. 9 is a cross-sectional view taken along an arrow IX-IX of FIG. 7.

Although the description is omitted in the above, in the present exemplary embodiment, as shown in FIG. 9, the disposition gap between the first protrusion 21 and the second protrusion 22 which are formed in a rib shape is greater than the width of the elastic piece 312 which is provided in the first regulating member 31. The elastic piece 312 is positioned between the first protrusion 21 and the second protrusion 22. Thereby, in the present exemplary embodiment, if the elastic piece 312 is pressed by the projecting portion 413 of the first contact member 41 and deformation of the elastic piece 312 is generated, the elastic piece 312 enters the gap which is formed between the first protrusion 21 and the second protrusion 22. Additionally, the elastic piece 312 is inserted between the first protrusion 21 and the second protrusion 22 without hitting on the first protrusion 21 or the second protrusion 22.

In the present exemplary embodiment, the first protrusion 21 and the second protrusion 22 are formed in a plate shape (rib shape). Thereby, the first protrusion 21 and the first regulating member 31 come into linear contact with each other, and the second protrusion 22 and the first regulating member 31 also come into liner contact with each other. Thereby, compared to the configuration in which the first protrusion 21 and the first regulating member 31 come into planar contact with each other and the second protrusion 22 and the first regulating member 31 come into planar contact with each other, the first regulating member 31 easily moves and the operation load of the cover member 23 is decreased.

In the present exemplary embodiment, one place in the longitudinal direction of the first regulating member 31 is supported by the apparatus main body 20. Thereby, the operation load of the cover member 23 is decreased. Here, for example, in a case where plural places, in which the positions in the longitudinal direction of the first regulating member 31 are different from each other, are supported by the apparatus main body 20 and supporting portions which support the first regulating member 31 are provided in plural, the frictional force which acts on the first regulating member 31 from the apparatus main body 20 is increased, and there is a concern that the operating force when the cover member 23 is opened and closed may be increased.

Here, according to the operating method of a user, the cover member 23 is not pulled straight to the front side and the cover member 23 may be pulled in a lateral direction (width direction of the image forming apparatus 100). In this case, the first regulating member 31 is not drawn straight and is drawn in the state of being inclined. Here, in this condition, if plural supporting portions are provided as described above, the first regulating member 31 is rotated about one supporting portion in the plural supporting portions, and the first regulating member 31 is pressed to the other supporting portions. Therefore, in this case, the frictional force between the first regulating member 31 and the supporting portions is increased and the operation force when the cover member 23 is opened and closed is increased.

The structure of the first contact member 41 will be further described with reference to FIG. 9.

As shown in FIG. 9 and described above, the first contact member 41 includes the main body portion 411 which is formed in a plate shape and a rectangular shape and the projecting portion 413 which is provided in the center portion in the longitudinal direction of the main body portion 411 and protrudes toward the second side wall 202 side. In the first contact member 41, a first piece 414 which protrudes from the one end in the longitudinal direction of the main body portion 411 and is disposed so as to be perpendicular to the main body portion 411 and a second piece 415 which is provided so as to protrude from the end of the free end side of the first piece 414 and disposed so as to be perpendicular to the first piece 414 are provided.

A long hole shaped recessed portion 416A is formed in a surface which is opposed to the second side wall 202 in the one end in the longitudinal direction of the main body portion 411, and a long hole shaped through hole 416B is formed in the bottom of the recessed portion 416A. In addition, a circular recessed portion 417A is formed in the other end in the longitudinal direction of the main body portion 411, and a circular through hole 417B is formed in the bottom of the recessed portion 417A. A circular through hole 418 is formed in a place which is adjacent to the recessed portion 417A in the other end in the longitudinal direction of the main body portion 411.

Here, as described above, the first contact member 41 is fixed by the first fixing portion 210 and the second fixing portion 220 which are provided in the inner wall of the second side wall 202. Next, an assembly procedure when the first fixing portion 210 and the second fixing portion 220 are fixed will be described. First, the second piece 415 is inserted into the through hole 211 which is formed in the opposing portion 212. At this time, the other end side of the first contact member 41 is separated from the second side wall 202, and the first contact member 41 is inclined to the second side wall 202. If the insertion of the second piece 415 into the through hole 211 is completed, the first piece 414 enters the through hole 211. Thereafter, the first contact member 41 is further pressed toward the second side wall 202 by a user.

Thereby, the protrusion 214 which is provided in the first fixing portion 210 enters the long hole shaped recessed portion 416A, and the first protrusion 222 which is provided in the second fixing portion 220 enters the round hole-shaped recessed portion 417A. The second protrusion 223 in which the screw hole is formed is opposite to the through hole 418 which is formed in the first contact member 41. Thereafter, the screw 224 passes through the through hole 418, and the screw 224 is fixed to the second protrusion 223. Thereby, the first contact member 41 is fixed to the inner wall of the second side wall 202.

Here, in the present exemplary embodiment, the first contact member 41 may be fixed by one screw 224, and compared to the case where both ends of the first contact member 41 are fixed by screws, the number of parts is decreased. In the present exemplary embodiment, the movement of the first contact member 41 is regulated by the recessed portion 417A and the first protrusion 222 which is inserted into the recessed portion 417A. In addition, the movement of the first contact member 41 is also regulated by the long hole shaped recessed portion 416A and the protrusion 214 which is inserted into the recessed portion 416A.

When the recessed portion 416A is formed in a round hole shape not the long hole shape, the protrusion 214 may not be inserted up to the inner portion of the recessed portion 416A. Specifically, in the configuration of the present exemplary embodiment, the first contact member 41 is inclined to the second side wall 202 as described above when the mounting of the first contact member 41 starts. However, at this time, if the recessed portion 416A is formed in a round hole, the top of the protrusion 214 hits the inner wall (inner circumferential surface) of the recessed portion 416A, and the protrusion 214 may not be inserted up to the inner portion of the recessed portion 416A. Thereby, in the present exemplary embodiment, the recessed portion 416A is formed in a long hole shape.

Next, the structure of the connection portion between the first regulating member 31 and the cover member 23 will be described.

Figure 10:
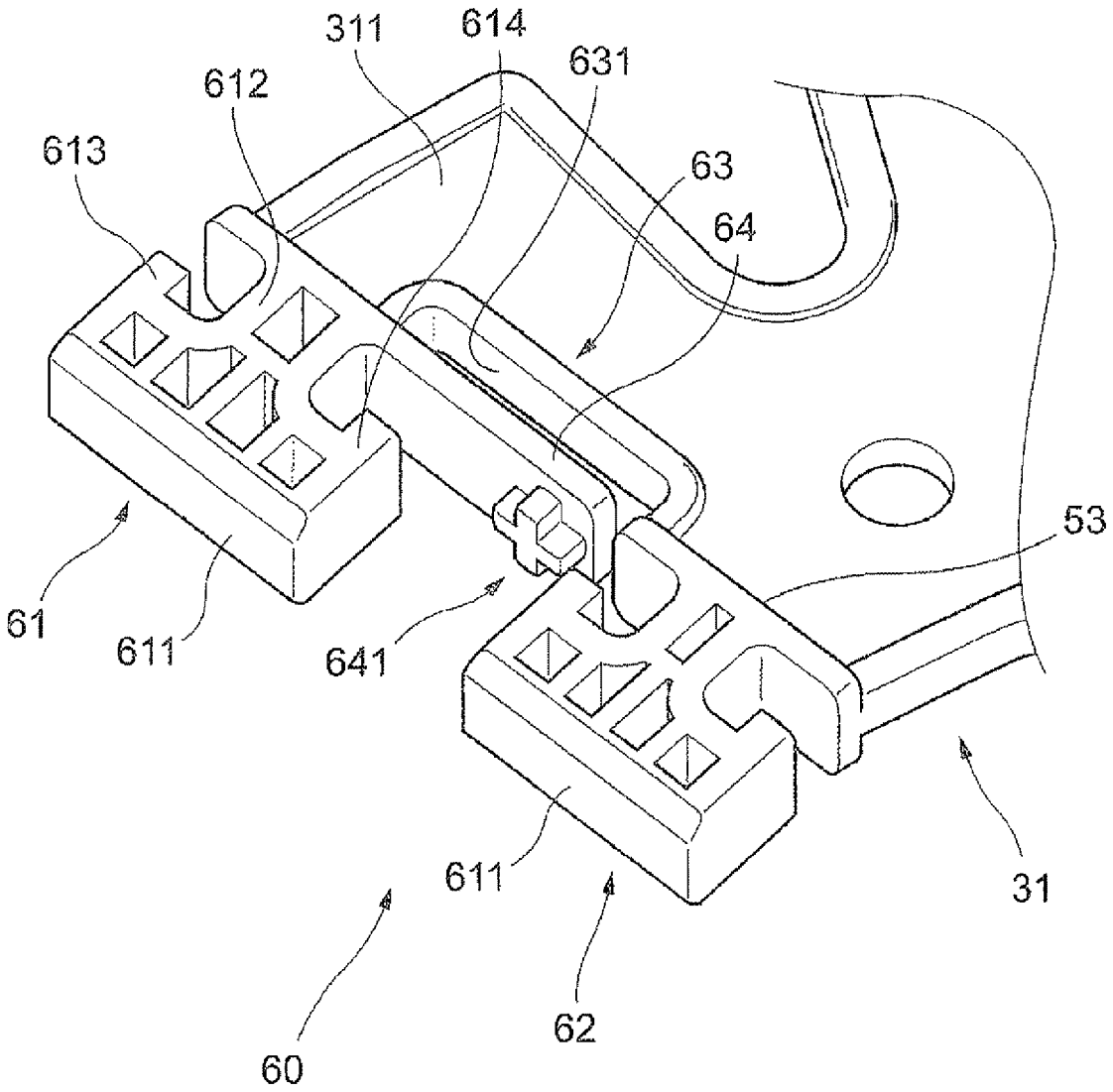
FIG. 10 is a view enlarging a portion of the first regulating member which is mounted on the cover member.

FIG. 10 is a view enlarging a portion of the first regulating member 31 which is mounted on the cover member 23. As described above, the mounting portion 60 which is mounted on the cover member 23 (refer to FIG. 2) is provided in the third lateral side 53 of the first regulating member 31. Here, as shown in FIG. 10, in the mounting portion 60, a first protrusion 61 which protrudes from one end in the longitudinal direction of the third lateral side 53, and a second protrusion 62 which protrudes from the other end in the longitudinal direction of the third lateral side 53 are provided. In the mounting portion 60, a recessed portion 63 which is provided in the center portion in the longitudinal direction of the third lateral side 53 and is recessed to the main body portion 311 side is provided.

In the present exemplary embodiment, an opposing piece 64 which is connected to a base of the first protrusion 61, is disposed toward a base of the second protrusion 62, and is disposed to be opposite to a bottom surface 631 of the recessed portion 63 is provided. Here, in the opposed piece 64, the one end is connected to the base of the first protrusion 61 and the other end is not connected to the base of the second protrusion 62. Therefore, the opposed piece 64 is formed in a cantilever beam. In the present exemplary embodiment, a projecting portion 641 which is formed in a cross shape when viewed from the front is formed on a surface of the opposite piece 64 which is a side opposite to the surface facing the bottom surface 631.

Here, the first protrusion 61 and the second protrusion 62 are configured to be similar to each other and the first protrusion 61 is described as one example. The first protrusion 61 is formed so as to be a T shape when viewed from the side surface. If the first protrusion 61 is described in more detail, in the first protrusion 61, a fitting portion 611 which is formed in a rectangular parallelepiped shape, is disposed along the third lateral side 53, and is fitted into recessed portions (described below) formed in the cover member 23 is provided. In the first protrusion 61, a connection portion 612 which connects the center portion in the longitudinal direction of the fitting portion 611 and the third lateral side 53 is provided. Here, the connection portion 612 is formed in a quadrangular prism shape.

In the first protrusion 61, a first protrusion 613 which protrudes from the one end in the longitudinal direction of the fitting portion 611 toward the third lateral side 53 and a second protrusion 614 which protrudes from the other end in the longitudinal direction of the fitting portion 611 toward the third lateral side 53 are provided. In addition, the first protrusion 613 and the second protrusion 614 do not reach up to the third lateral side 53 and gaps are formed between the first protrusion 613 and the third lateral side 53 and the second protrusion 614 and the third lateral side 53. In the present exemplary embodiment, in order to prevent sink marks generated due to injection molding, a so-called thickness thinning is performed with respect to the first protrusion 61 and the second protrusion 62.

Next, the structure of the cover member 23 side will be described.

Figure 11:
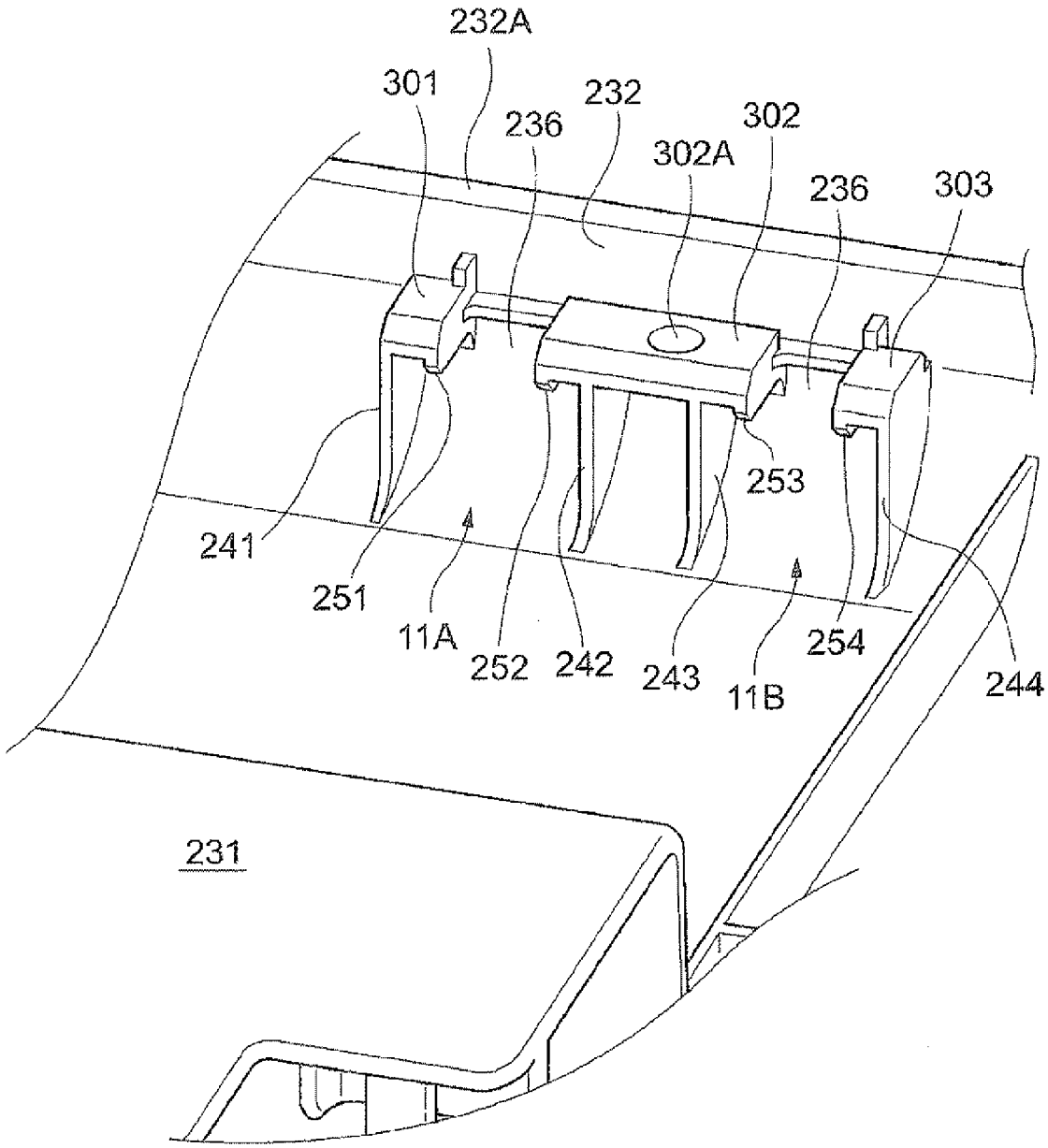
FIG. 11 is a view enlarging a portion of the cover member on which the first regulating member is mounted.

FIG. 11 is a view enlarging a portion of the cover member 23 on which the first regulating member 31 is mounted.

As shown FIG. 11 and FIG. 2, in the cover member 23, a cover portion 231 which is formed in a plate shape and covers the opening formed in the apparatus main body 20 is provided. In the cover member 23, a side wall 232 which is connected to the both ends in the width direction of the cover portion 231 and is opposite to the first side wall 201 and the second side wall 202 of the apparatus main body 20 when the cover member 23 is closed by a user is provided.

In the present exemplary embodiment, as shown in FIG. 11, a first projecting piece 301 which is provided so as to protrude from the side wall 232, is disposed so as to be perpendicular to the side wall 232, and is formed in a plate shape and a rectangular shape is provided. In addition, similarly, a second projecting piece 302 and a third projecting piece 303 which are provided so as to protrude from the side wall 232, is disposed so as to be perpendicular to the side wall 232, and is formed in a plate shape and a rectangular shape are provided. A circular through hole 302A is formed in the center portion in the longitudinal direction of the second projecting piece 302.

Here, in the direction from the upper left toward the lower right in FIG. 11, the first projecting piece 301, the second projecting piece 302, and the third projecting piece 303 are disposed in the above order. The first to the third projecting pieces 301 to 303 are disposed to rest on the same straight line and are disposed along a direction in which an edge 232A of the side wall 232 extends. In addition, gaps 236 are formed between the first projecting piece 301 and the second projecting piece 302 and between the second projecting piece 302 and the third projecting piece 303.

In the present exemplary embodiment, a first wall portion 241 which is formed in a plate shape (rib shape) and is connected to the first projecting piece 301, the cover portion 231, and the side wall 232 is provided. Similarly, a second wall portion 242 and a third wall portion 243 which are formed in a plate shape and are connected to the second projecting piece 302, the cover portion 231, and the side wall 232 are provided. A fourth wall portion 244 which is formed in a plate shape and is connected to the third projecting piece 303, the cover portion 231, and the side wall 232 is provided. The first to the fourth wall portions 241 to 244 are disposed so as to be perpendicular to the cover portion 231 and the side wall 232.

Here, the first wall portion 241 is provided so as to be connected to an end of the side opposite to the end positioned at the side in which the second projecting piece 302 is provided in the ends of the first projecting piece 301. The second wall portion 242 is provided so as to be connected to a portion of the second projecting piece 302 which is positioned in the first projecting piece 301 side. In addition, the third wall portion 243 is provided so as to be connected to a portion of the second projecting piece 302 which is positioned in the third projecting piece 303 side. The fourth wall portion 244 is provided so as to be connected to an end of the side opposite to the end positioned at the side in which the second projecting piece 302 is provided in the ends of the third projecting piece 303.

A first protrusion 251 which protrudes to the side in which the cover portion 231 is provided is formed in the end of the first projecting piece 301 (end of side close to second projecting piece 302). A second protrusion 252 and a third protrusion 253 which protrude to the side in which the cover portion 231 is provided are formed in both ends of the second projecting piece 302 (end of first projecting piece 301 side and end of third projecting piece 303 side). Moreover, a fourth protrusion 254 which protrudes to the side in which the cover portion 231 is provided is formed in the end of the third projecting piece 303 (end of side close to second projecting piece 302).

Figure 12:
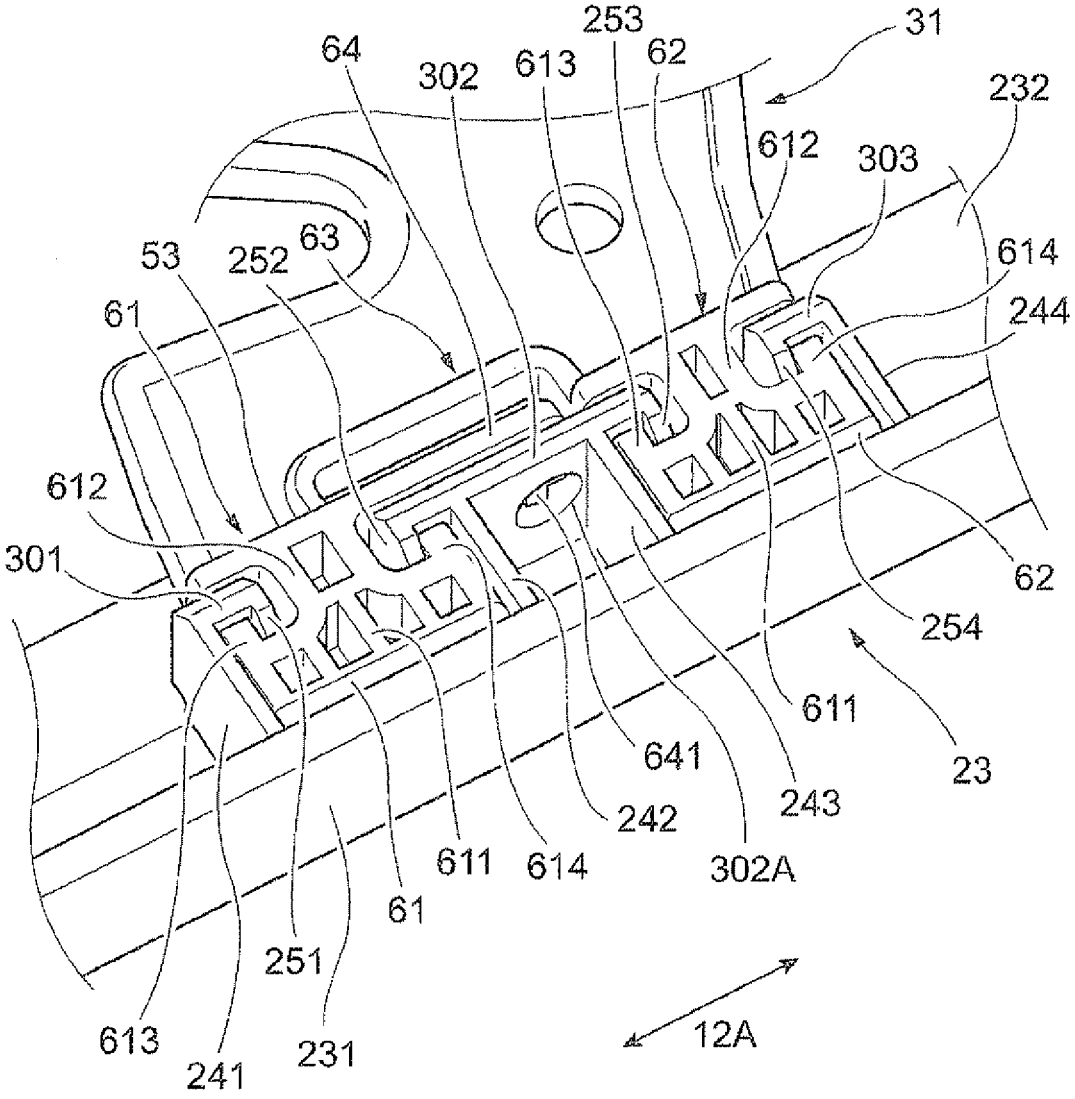
FIG. 12 is a view showing a state after the first regulating member is mounted on the cover member.

FIG. 12 is a view showing a state after the first regulating member 31 is mounted on the cover member 23.

Here, the mounting of the first regulating member 31 on the cover member 23 is performed due to the fact that the fitting portion 611 of the first protrusion 61 is fitted to a space (also refer to reference numeral 11A in FIG. 11) which is surrounded by the first wall portion 241, the second wall portion 242, the first projecting piece 301, the second projecting piece 302, the cover portion 231, and the side wall 232. The mounting of the first regulating member 31 on the cover member 23 is performed due to the fact that the fitting portion 611 of the second protrusion 62 is fitted to a space (also refer to reference numeral 11B in FIG. 11) which is surrounded by the third wall portion 243, the fourth wall portion 244, the second projecting piece 302, the third projecting piece 303, the cover portion 231, and the side wall 232.

Here, if the fitting portion 611 is fitted to the spaces, the connection portion 612 of the first protrusion 61 is positioned in the space 236 (refer to FIG. 11) which is formed between the first projecting piece 301 and the second projecting piece 302. The connection portion 612 of the second protrusion 62 is positioned in the space 236 (refer to FIG. 11) which is formed between the second projecting piece 302 and the third projecting piece 303.

In addition, if the fitting portion 611 is fitted to the spaces, the first protrusion 613 of the first protrusion 61 is positioned between the first wall portion 241 and the first protrusion 251 which protrudes from the first projecting piece 301. The second protrusion 614 of the first protrusion 61 is positioned between the second wall portion 242 and the second protrusion 252 which protrudes from the second projecting piece 302. The first protrusion 613 of the second protrusion 62 is positioned between the third wall portion 243 and the third protrusion 253 which protrudes from the second projecting piece 302. The second protrusion 614 of the second protrusion 62 is positioned between the fourth wall portion 244 and the fourth protrusion 254 which protrudes from the third projecting piece 303.

In the state shown in FIG. 12, the projecting portion 641 which is formed in the opposed piece 64 is inserted to the inner portion of the through hole 302A which is formed in the second projecting piece 302. When the fitting portion 611 is fitted to the spaces, the opposed piece 64 is bent to the recessed portion 63 side. Thereby, the opposed piece 64 may be disposed so as to be overlapped with the second projecting piece 302 and the projecting portion 641 which is formed in the opposed piece 64 may be fitted to the through hole 302A of the second projecting piece 302.

Here, when the cover member 23 is opened by a user, the cover member 23 is pulled to the direction which is separated from the first regulating member 31. At this time, the first projecting piece 301 which is formed in the cover member 23 is pressed to the first protrusion 613 of the first protrusion 61, and the second projecting piece 302 is pressed to the second protrusion 614 of the first protrusion 61. Moreover, similarly, the second projecting piece 302 which is formed in the cover member 23 is pressed to the first protrusion 613 of the second protrusion 62, and the third projecting piece 303 is pressed to the second protrusion 614 of the second protrusion 62. Thereby, the movement of the cover member 23 with respect to the first regulating member 31 is regulated, and the first regulating member 31 is suppressed from being removed from the cover member 23.

According to the operating method of a user, the cover member 23 may be operated so that the cover member 23 moves in the width direction of the image forming apparatus 100. In this case, the second projecting piece 302 (inner circumferential surface of through hole 302A) of the cover member 23 is pressed to the projecting portion 641 which is formed in the opposed piece 64. Thereby, also in this case, the movement of the cover member 23 with respect to the first regulating member 31 is regulated, and the first regulating member 31 is suppressed from being removed from the cover member 23.

For example, external force acts on the first regulating member 31 or the like, and the first regulating member 31 may move in a direction (direction indicated by arrow 12A in FIG. 12) in which the third lateral side 53 of the first regulating member 31 extends. In this case, the first to the fourth protrusions 251 to 254 which are provided in the first to the third projecting pieces 301 to 303, and the first protrusion 613 and the second protrusion 614 which are provided in the first protrusion 61 and the second protrusion 62 push one another. In this case, the first protrusion 61 collides with the first wall portion 241 and the second wall portion 242, and the second protrusion 62 collides with the third wall portion 243 and the fourth wall portion 244. Thereby, also in this case, the first regulating member 31 is suppressed from being removed from the cover member 23.

In the above, the case where the cover member 23, the first regulating member 31, the second regulating member 32, and the like are provided in the image forming apparatus 100 is described. However, the above-described configuration may be applied to apparatuses other than the image forming apparatus 100. For example, the configuration may be applied to an apparatus which makes a booklet bundling plural sheets of paper, an apparatus which binds plural sheets of paper by using staples or the like, an apparatus which drills paper, or the like.

In the above, the case where the elastic piece 312 is provided in the one end 55 side of the first regulating member 31 is described. However, the elastic piece 312 may be provided in the other end 56 side in the first regulating member 31. Additionally, instead of the recessed portion 57, the projecting portion 58, and the inclined surface 59 shown FIG. 3A, the slit 70 and the elastic piece 312 may be provided. In this case, when the cover member 23 is opened by a user, the elastic piece 312 is pressed by the projecting portion 413 of the first contact member 41 and is bent.

Moreover, in the case where the elastic piece 312 is provided in the other end 56 side in the first regulating member 31, the end of the elastic piece 312 which is positioned in the one end 55 side of the first regulating member 31 becomes a fixed end, and the end of the elastic piece 312 which is positioned in the other end 56 side of the first regulating member 31 becomes a free end. Additionally, in the case where the elastic piece 312 is provided in the other end 56 side of the first regulating member 31, the end of the elastic piece 312 which is positioned in the one end 55 side of the first regulating member 31 is connected to the main body portion 311 of the first regulating member 31, and the end of the elastic piece 312 which is positioned in the other end 56 side of the first regulating member 31 becomes a free end.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording material processing apparatus comprising:

an apparatus main body that includes a processing unit performing a predetermined processing with respect to a recording material;

a cover member that is provided so as to be opened and closed with respect to the apparatus main body, is provided so as to be opened up to a predetermined place, and covers a predetermined place on the apparatus main body;

a drag applying portion that is provided in the apparatus main body side and is used so as to apply drag to the cover member opened and closed by a user; and a drag receiving member that is provided in the cover member side, receives the drag from the drag applying portion when the drag applying portion presses and the cover member is opened and closed, and is elastically deformed when a portion placed opposite to the drag applying portion in a state where the cover member is closed and/or a portion placed opposite to the drag applying portion when the cover member is opened up to the predetermined place is pressed by the drag applying portion.

2. The recording material processing apparatus according to claim 1, wherein the portion placed opposite to the drag applying portion is elastically deformed, and an inclined surface is formed in the portion placed opposite to the drag applying portion.

3. The recording material processing apparatus according to claim 2, wherein the portion placed opposite to the drag applying portion includes a first end and a second end, the portion placed opposite to the drag applying portion is elastically deformed when being pressed by the drag applying portion and is bent while having the first end as a free end and the second end as a fixed end, and the portion placed opposite to the drag applying portion is bent while having the first end as a free end and the second end as a fixed end, and the inclined surface is formed in the portion placed opposite to the drag applying portion.

4. The recording material processing apparatus according to claim 1, wherein a first end side of the drag receiving member is mounted on the cover member, and the drag receiving member is provided from the cover member toward the apparatus main body side and includes a second end of a side opposite to the first end and a side portion which connects the first end and the second end, and the side portion of the drag receiving member includes a notch.

5. The recording material processing apparatus according to claim 2, wherein a first end side of the drag receiving member is mounted on the cover member, and the drag receiving member is provided from the cover member toward the apparatus main body side and includes a second end of a side opposite to the first end and a side portion which connects the first end and the second end, and the side portion of the drag receiving member includes a notch.

6. The recording material processing apparatus according to claim 3, wherein a first end side of the drag receiving member is mounted on the cover member, and the drag receiving member is provided from the cover member toward the apparatus main body side and includes a second end of a side opposite to the first end and a side portion which connects the first end and the second end, and the side portion of the drag receiving member includes a notch.

7. The recording material processing apparatus according to claim 1, wherein the drag receiving member is formed in a plate shape and a first side surface of the drag receiving member is pressed by the drag applying portion.

8. The recording material processing apparatus according to claim 2, wherein the drag receiving member is formed in a plate shape and a first side surface of the drag receiving member is pressed by the drag applying portion.

9. The recording material processing apparatus according to claim 3, wherein the drag receiving member is formed in a plate shape and a first side surface of the drag receiving member is pressed by the drag applying portion.

10. The recording material processing apparatus according to claim 4, wherein the drag receiving member is formed in a plate shape and a first side surface of the drag receiving member is pressed by the drag applying portion.

11. The recording material processing apparatus according to claim 5, wherein the drag receiving member is formed in a plate shape and a first side surface of the drag receiving member is pressed by the drag applying portion.

12. The recording material processing apparatus according to claim 6, wherein the drag receiving member is formed in a plate shape and a first side surface of the drag receiving member is pressed by the drag applying portion.

13. A recording material processing apparatus comprising:

an apparatus main body that includes a processing unit performing a predetermined processing with respect to a recording material;

a cover member that is provided so as to be opened and closed with respect to the apparatus main body and covers a predetermined place on the apparatus main body;

a drag applying portion that is provided in the apparatus main body side and is used so as to apply drag to the cover member opened and closed by a user; and a drag receiving member that includes a first end mounted on the cover member, is provided from the cover member toward the apparatus main body side, includes a second end opposite to the first end, receives the drag from the drag applying portion when the drag applying portion presses and the cover member is opened and closed, and includes a bending piece bent when pressed by the drag applying portion in a place placed opposite to the drag applying portion in the state where the cover member is closed, in which the bending piece is bent while having one end, as a free end, among the one end that is positioned at the first end side and the other end that is positioned in the second end side.

14. The recording material processing apparatus according to claim 13, wherein the bending piece is bent, and the place of the drag receiving member placed opposite to the drag applying portion includes an inclined surface.

15. The recording material processing apparatus according to claim 13, wherein the drag receiving member is provided with a through hole.

16. The recording material processing apparatus according to claim 14, wherein the drag receiving member is provided with a through hole.

17. A recording material processing apparatus comprising:

an apparatus main body that includes a processing unit performing a predetermined processing with respect to a recording material;

a cover member that is provided so as to be opened and closed with respect to the apparatus main body, is provided so as to be opened up to a predetermined place, and covers a predetermined place on the apparatus main body;

a drag applying portion that is provided in the apparatus main body side and is used so as to apply drag to the cover member opened and closed by a user; and a drag receiving member that includes a first end mounted on the cover member, is provided from the cover member toward the apparatus main body side, includes a second end opposite to the first end, receives the drag from the drag applying portion when the drag applying portion presses and the cover member is opened and closed, and includes a bending piece bent when pressed by the drag applying portion in a place placed opposite to the drag applying portion when the cover member is opened up to the predetermined place, in which the bending piece is bent while having the other end, as a free end, among one end that is positioned at the first end side and the other end that is positioned in the second end side.

* * * * *